US008046974B2

(12) United States Patent
Lewis

(10) Patent No.: US 8,046,974 B2
(45) Date of Patent: Nov. 1, 2011

(54) BOTTLE CLOSURE WITH LOW TORQUE ASSEMBLY FEATURE

(75) Inventor: William N. Lewis, Hamilton Square, NJ (US)

(73) Assignee: Guest Supply, Inc., Monmouth Junction, NJ (US)

( * ) Notice: Subject to any disclaimer, the term of this patent is extended or adjusted under 35 U.S.C. 154(b) by 0 days.

(21) Appl. No.: 12/700,328

(22) Filed: Feb. 4, 2010

(65) Prior Publication Data

US 2010/0133225 A1 Jun. 3, 2010

Related U.S. Application Data

(63) Continuation of application No. 11/007,511, filed on Dec. 7, 2004, now abandoned.

(51) Int. Cl.
*B67B 3/02* (2006.01)

(52) U.S. Cl. ..... 53/317; 53/485; 215/330; 215/357; 215/44; 220/316; 220/836

(58) Field of Classification Search ..... 53/476, 53/484, 485, 490, 285, 287, 317; 220/367.1, 220/805, 303, 296, 293, 289, 325, 324, 836, 220/810, 302, 301, 300, 316; 215/317, 321, 215/320, 331, 330, 357, 356, 355, 235, 360, 215/44, 43, 316, 243, 237, 358, 337, 329, 215/318

See application file for complete search history.

(56) References Cited

U.S. PATENT DOCUMENTS

| | | | | | |
|---|---|---|---|---|---|
| 2,135,330 | A * | 11/1938 | Desser | 222/572 |
| 3,342,385 | A * | 9/1967 | Knight | 222/485 |
| 3,430,798 | A * | 3/1969 | Goyet et al. | 215/295 |
| 4,653,676 | A * | 3/1987 | Stull | 222/566 |
| 5,063,725 | A * | 11/1991 | Kent et al. | 53/485 |
| 5,097,974 | A * | 3/1992 | Rozenberg | 215/225 |
| 5,423,441 | A * | 6/1995 | Conti | 215/225 |
| 5,927,531 | A * | 7/1999 | Kuzma et al. | 215/321 |
| 6,789,691 | B2 * | 9/2004 | Martin et al. | 220/296 |
| 7,210,593 | B2 * | 5/2007 | Stull et al. | 215/252 |

* cited by examiner

*Primary Examiner* — Paul Durand
(74) *Attorney, Agent, or Firm* — Steve Rosenblatt

(57) ABSTRACT

A closure system for a container reduces the needed torque for assembly by minimizing frictional resistance to rotation of the closure into its desired alignment with the container before the closure is driven home onto the container neck. The reduction in the torque resistance during the application of the closure allows the rotary filling machinery to work within its torque limits and minimizes damage to the parts during the filling and sealing operation in a bottle filling line.

11 Claims, 2 Drawing Sheets

BOTTLE CLOSURE WITH LOW TORQUE ASSEMBLY FEATURE

CROSS-REFERENCE TO RELATED APPLICATION

This application is a continuation application claiming priority from U.S. patent application Ser. No. 11/007,511, filed Dec. 7, 2004.

FIELD OF THE INVENTION

The field of this invention is closures for bottles and more particularly for bottles capped with a rotary capper.

BACKGROUND OF THE INVENTION

High speed filling lines are commonly used to fill a variety of containers of various shapes and sizes. The machinery typically positions the receiving container for the product in alignment with a fill nozzle or outlet. After the product is delivered, a closure is put on to seal the bottle. The capping machinery has controls built in that are used in placement of the closure. In order to assure rapid and secure placement of the closure, the equipment needs to be able to deliver certain forces and torques to secure the closure. For closures that secure by snap or interference fit, there is a balance that needs to be drawn between getting a secure slip free contact between the container and the closure and the limits of the machinery to deliver the desired force and keep the filling line moving at the desired speed. If the clearances are too tight the resulting required forces can get too high for the capping equipment. This can result in an incomplete placement of the closure on the container and potential product leakage along the distribution chain.

Figure 1:
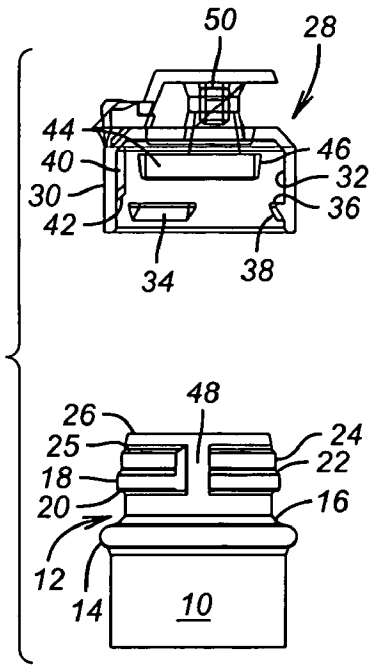
(PRIOR ART) FIG. 1

FIGS. 1-6 illustrate this problem in a prior art bottle that uses a snap fit closure onto the neck of an elongated bottle. Referring to FIG. 1, the bottle 10 has a neck generally indicated at 12 at its top end. A support ring 14 defines the beginning of the neck 12 and features an upwardly oriented shoulder 16. A ring 18 located above support ring 14 defines an undercut radial surface 20. Above ring 18 and working up to the top of the neck 12 are a pair of transition surfaces 22 and 24 that ultimately lead to the top 26 of the neck 12. The closure 28 is shown above the bottle 10 in the position that the capping machinery would hold it before driving it home onto the neck 12. Closure 28 has an outer surface 30 and an inner surface 32. Inner surface 32 has a series of circumferentially spaced inwardly oriented projections 34 that each features a radial surface 36 adjacent a tapered and downwardly extending surface 38. Inner surface 32 also features a longitudinally extending and generally rectangular shaped key 40 having a taper 42 at its lower end. A ring 44 is disposed concentrically to inner surface 32 and has a gradual exterior outward taper 46. Neck 12 further comprises a longitudinally oriented gap 48 which is wider than key 40, for reasons that will be explained below. Closure 28 has an outlet 50 which can be any known design for getting the product out of the bottle 10 when it is placed in use.

With the components now having been described, the process of assembling the closure 28 to the bottle 10 will now be described and in the process, its limitations will be more readily understood. Those skilled in the art will appreciate that the machinery that is not shown receives a closure 28 in a random orientation with regard to the location of key 40. Stated differently, key 40 may or may not be axially aligned with gap 48 when the closure 28 is brought down on the neck

Figure 2:
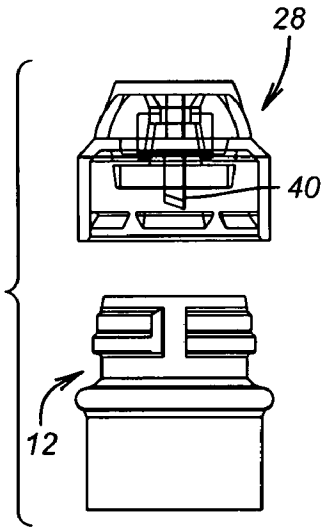
(PRIOR ART) FIG. 2
Figure 3:
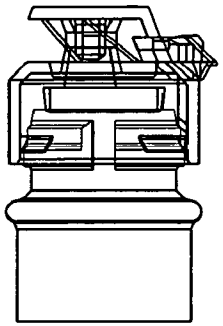
(PRIOR ART) FIG. 3
Figure 4:
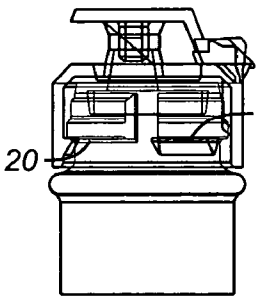
(PRIOR ART) FIG. 4
Figure 5:
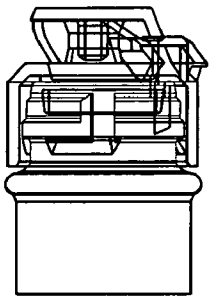
(PRIOR ART) FIG. 5
Figure 6:
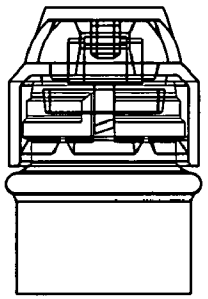
(PRIOR ART) FIG. 6

12. Comparing FIGS. 1 and 2, it can be seen that the closure 28 has been brought closer to the neck 12 and that closure 28 has been rotated about its vertical axis to change the orientation of the key 40 with respect to the gap 48. In FIG. 2, they are in further misalignment than they were in FIG. 1. FIG. 3 compared to FIG. 2 shows further downward movement of closure 28 as well as a further rotation of about 90° about its vertical axis as compared to the FIG. 2 position. In FIG. 3, tapered surface 38 has landed on transition surface 22 of neck 12. Taper 42 at the lower end of key 40 has landed on tapered surface 25 just below the top 26 of the neck 12. It is apparent that key 40 is still misaligned with gap 48 in this position. Tapered surface 46 of ring 44 is inside the top end 26 and on the verge of contact with the inside wall of the neck 12. Now comparing FIG. 4 to FIG. 3, the closure 28 has been pushed further down but not rotated by much. At this point radial surface 36 has been snapped to below radial surface 20. Tapered surface 46 of ring 44 is now in contact with the inside surface of the neck 12 just below end 26. Key 40 is now straddling ring 18. Those skilled in the art will appreciate that subsequent effort to rotate the closure 28 after being forced down to the FIG. 4 position will engender significant resistance from several contact points with neck 12. The key 40 extending over ring 18 will resist rotation as will the rubbing of ring 44 inside the upper end 26 of the neck 12. Finally, there is an upward force that forces radial surface 36 of closure 28 up against radial surface 20 of ring 18 on the neck 12. This residual force results from the dimensions of the components and the driving of the closure 28 down over ring 18. The problem in the past with this design is that the equipment is either torque limited or has settings that limit applied torque to the closure 28 to avoid component damage by forcing a fit in situations where the components may not be totally in axial alignment. The compound effect of these interference fits that are desirable in assuring the securing of the closure 28 to the bottle 10 become a disadvantage during the filling process. Comparing now FIG. 5 to FIG. 4, it can be seen that the closure is rotated about its longitudinal axis to bring key 40 closer to gap 48. The assembly is finished when key 40 snaps off ring 18 and settles into gap 48 to rotationally lock the closure 28 to the neck 12.

The present invention improves the configuration of the components to greatly reduce the required torque to assemble them while, in the end, allowing them to be securely connected to each other as in the past. One way this is accomplished is an emphasis on getting the components into their final alignment positions at a time when less interference contact exists, thus greatly reducing the required torque for rotating the closure into its final position. In the end the closure is just as secure as in the prior art design but the assembly process has been optimized in view of the low applied torque required to reach the final made up position of the components. These and other advantages of the present invention will more readily be understood by those skilled in the art from a review of the remaining drawings and the associated description of the preferred embodiment as well as the claims for the invention that appear below.

SUMMARY OF THE INVENTION

A closure system for a container reduces the needed torque for assembly by minimizing frictional resistance to rotation of the closure into its desired alignment with the container before the closure is driven home onto the container neck. The reduction in the torque resistance during the application of the closure allows the high speed filling machinery to work within its torque limits and minimizes damage to the parts during the filling and sealing operation in a high speed filling line.

DETAILED DESCRIPTION OF THE DRAWINGS

FIGS. 1-6 are a series of views showing the assembly in progress of applying the closure to the neck of a container in the prior art design; and FIGS. 7-12 are sequential views of the present invention showing the closure being applied to the container.

DETAILED DESCRIPTION OF THE PREFERRED EMBODIMENT

Figures 7, 8, 9, 10, 11, 12:
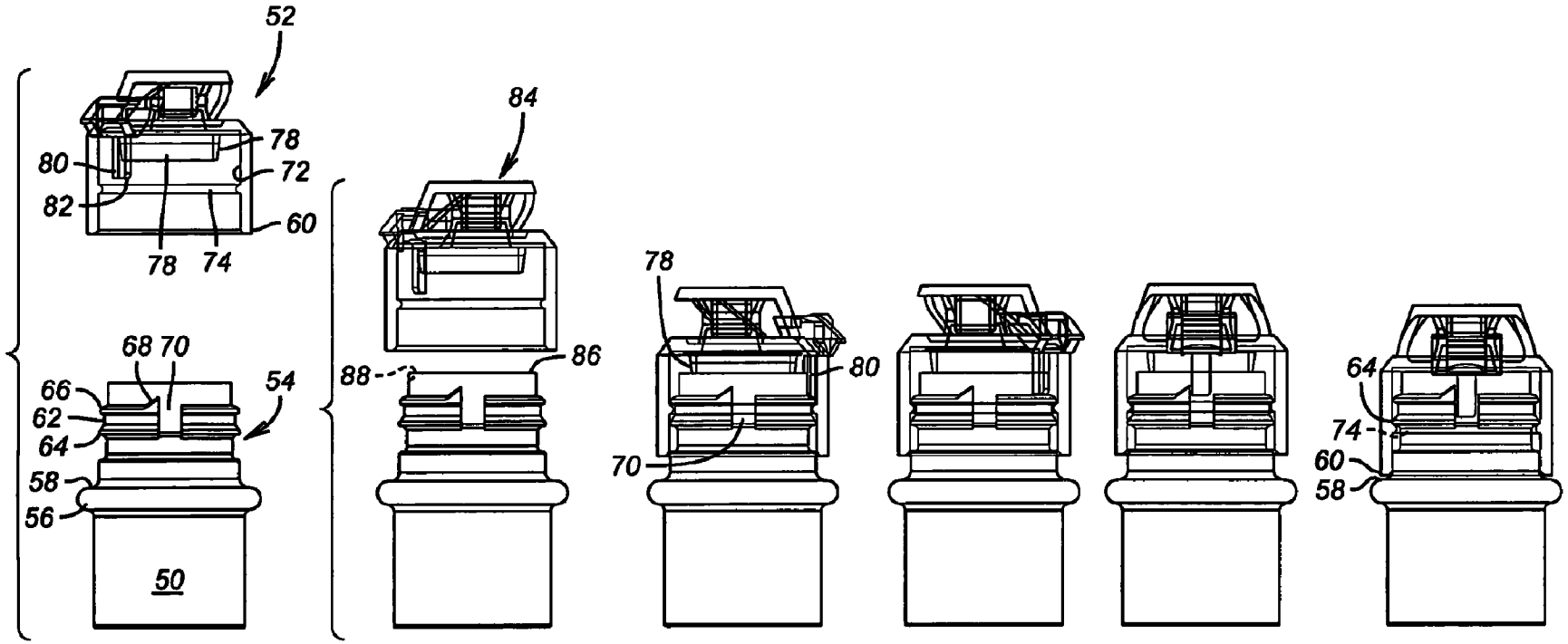

Referring to FIG. 7, the container 50 accepts the closure 52. Container 50 has a neck 54 having an optional ring 56 that features an upper surface 58 that, if used, does not necessarily support the closure 52. Lower end 60 of closure 52 ultimately comes to be supported off of surface 58, as shown in FIG. 12 or can lay close to it without contact. Neck 54 further comprises a circumferential recess 62 disposed between rings 64 and 66. Ring 66 has a ramp 68 adjacent an indexing gap 70 that spans rings 64 and 66 and recess 62. Closure 52 had an interior circumferential surface 72 featuring a circular projection 74 that may be continuous or in discrete segments. Inner ring 76 has an exterior tapered surface 78. A longitudinally oriented indexing key 80 has a tapered lower end 82 that extends down to a point short of projection 74. Closure 52 has an outlet 84 of a type known in the art. Those skilled in the art will appreciate that indexing key 80 can be on the neck 54 and indexing groove 70 can be on the closure 52 as that option is a transposition of parts that function in the same way. In the same manner the rings 64 and 66 and the recess 62 between them can be transposed with projection or bead 74 within the scope of the invention.

FIG. 8 shows the closure 52 brought closer to the container 50 while it is rotated about a vertical axis. There is still no contact at this time. In FIG. 9 the closure has been lowered and rotated a further amount. Note that the key 80 is still out of alignment with the gap 70. However, at this time the circular projection 74 has passed ring 66 and landed in recess 62 between rings 64 and 66 for temporary support in that position. The lower end 82 of the key 80 is just above or right at ring 66. Tapered surface 78 of ring 76 is inside the upper end 86 of the neck 54 and preferably out of contact or in light guiding contact with the inside surface 88 of the neck 54. Lower end 60 of closure 52 is above surface 58. Having reached this position, further relative rotation can occur with minimal resistance as compared to the prior design described in FIGS. 1-6. For one thing the key 80 is not straddling any ring such as 64 or 66 even when it is misaligned with the gap 70. Projection or bead 74 having jumped over ring 66 on the way down into recess 64 now loosely fits in that recess 64 and uses rings 64 and 66 for guides, as the closure 52 is further rotated, as shown in FIGS. 10 and 11. Finally, the closure is guided for rotation by the extension of ring 76 into upper end 86 but without significant or any dragging of tapered surface 78 on the inside surface 88 of neck 54. In essence the closure is guided at three locations off of neck 54 as the closure 52 is rotated to bring the key 80 into alignment with gap 70. These three points of support for low resistance to applied torque are the disposing of projection 74 loosely within recess 64; letting lower end 82 of key 80 ride on or slightly above ring 66 and guiding the top of closure 52 within neck 54 by the extension of ring 76 into end 86 when tapered surface 78 is just out of touch or lightly contacting inside surface 88 of neck 54.

As shown in FIG. 11, the key 80 has been turned into alignment with gap 70 to allow the closure 52 to now be pushed down as shown in FIG. 12. By doing that, the lower end 60 comes to rest on or near support surface 58. Projection 74 has jumped out of recess or support groove 62 to a position under ring 64 and taper 78 of ring 76 is in an interference contact with inside surface 88 of neck 54. It should be noted that the movement in FIG. 12 involves no rotation as alignment of the key 80 with the gap 70 has previously been achieved. In this position ring 64 retains projection 74 to hold the closure 52 to the neck 54.

Those skilled in the art will appreciate that a number of initial orientations of the key 80 to the gap 70 are possible when the FIG. 9 position is initially reached. The purpose of the ramp 68 is to push closure 52 in a clockwise direction to begin the orientation process until key 80 winds up in alignment with gap 70. Of course if there is perfect initial alignment between key 80 and gap 70 the closure is simply pushed down as the machinery senses resistance to rotation because key 80 will not jump out of gap 70 and over ramp 68 without an amount of torque that will trip a switch on the machinery against over-torque. At that point, the equipment will simply push the closure 52 straight down. To reduce resistance to rotation even further, the neck 54 and the closure 52 internals can be made from a lubricious material or can have a small amount of a lubricant applied to the contacting surfaces to further reduce resistance to turning to seek the proper orientation before pushing the closure 52 to its final position on the neck 54.

The foregoing disclosure and description of the invention are illustrative and explanatory thereof, and various changes in the size, shape and materials, as well as in the details of the illustrated construction, may be made without departing from the invention.

I claim:

1. A closure system for a container, comprising:

a container terminating in a neck terminating in an end, said neck comprising one of an indexing groove and an indexing key on an exterior portion thereof;

a closure further comprising the other of an indexing key and an indexing groove for selective insertion of said key into said indexing groove to prevent relative rotation between said closure and said neck;

a machine to join said closure to said neck;

a first support surface on said closure selectively engaging a second support surface on said neck to guide said closure during relative rotation, caused by said machine, with respect to said neck where said indexing key provides no substantial resistance to said relative rotation which facilitates alignment of said key with said indexing groove for securing said closure to said neck with said machine said second support surface comprises a support groove and said first support surface comprises a projection that rides in said support groove during said relative rotation to align said key with said indexing groove.

2. The closure system of claim 1, wherein:

said support groove is formed between a pair of rings.

3. The closure system of claim 2, wherein:

said rings are continuous.

4. The closure system of claim 2, wherein:

said projection comprises a ridge that jumps over one of said rings to land in said support groove to support said closure in a position with said key extending past said end of said neck and above said rings.

5. The closure system of claim 4, wherein:

said ridge jumps over another of said rings when said key is aligned with said indexing groove.

6. The closure system of claim 4, wherein:

a guide surface on said closure that enters said end of said neck when said first and second support surfaces initially engage to guide said relative rotation between said closure and said neck without providing substantive resistance to said relative rotation.

7. The closure system of claim 6, wherein:

said neck is circular and defines an inner wall extending from said end thereof;

said guide surface comprises a tapered annular surface that is suspended adjacent said inner wall as said indexing key is rotated into alignment with said indexing groove.

8. The closure system of claim 7, wherein:

said tapered annular surface wedges against said inner wall as said closure is advanced over said neck with said key aligned to said indexing groove.

9. The closure system of claim 1, further comprising:

a guide surface on said closure that enters said end of said neck when said first and second support surfaces initially engage to guide said relative rotation between said closure and said neck without providing substantive resistance to said relative rotation.

10. The closure system of claim 9, wherein:

said guide surface comprises a tapered annular surface that is suspended adjacent said inner wall as said indexing key is rotated into alignment with said indexing groove.

11. The closure system of claim 10, wherein:

said tapered annular surface wedges against said inner wall as said closure is advanced over said neck with said key aligned to said indexing groove.

* * * * *